United States Patent [19]

Moser et al.

[11] 4,204,951

[45] May 27, 1980

[54] APPARATUS FOR SORTING CAPSULES AND THE LIKE

[75] Inventors: Theo Moser, Remseck; Andrä Rolf; Roland Rittler, both of Fellbach; Armin Strampfer, Hegnach, all of Fed. Rep. of Germany

[73] Assignee: Robert Bosch GmbH, Stuttgart, Fed. Rep. of Germany

[21] Appl. No.: 905,075

[22] Filed: May 11, 1978

[30] Foreign Application Priority Data

May 18, 1977 [DE] Fed. Rep. of Germany ..... 2722499

[51] Int. Cl.[2] ..... B07C 5/06

[52] U.S. Cl. ..... 209/625; 209/632; 209/634; 209/643; 209/684

[58] Field of Search ..... 209/625, 629, 632, 643, 209/680, 684, 634

[56] References Cited

U.S. PATENT DOCUMENTS 3,997,058 12/1976 Greer ..... 209/680

*Primary Examiner*—Allen N. Knowles

*Attorney, Agent, or Firm*—Edwin E. Greigg

[57] ABSTRACT

In order to sort a quantity of hard gelatin capsules of the type having at least a top and bottom and being filled with powdery contents, and to remove therefrom defective capsules which do not have a top or which may be cut or deformed in some way, the apparatus includes a first member with apertures for the capsules and a second member with similar apertures which are aligned with the first apertures in a first relative position of the two members. By applying suction to the top of the second member, intact capsules are urged into the second member while defective or deformed capsules are retained in the calibrated bore of the lower member. The two members undergo a relative displacement subsequent to which a discharge device moves rods into the individual orifice causing the discharge of intact capsules and defective capsules into different receiver chutes.

5 Claims, 5 Drawing Figures

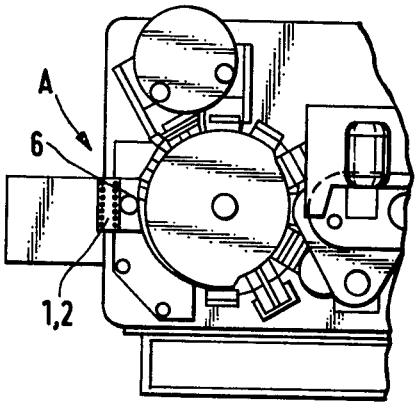
FIG.1
FIG.4
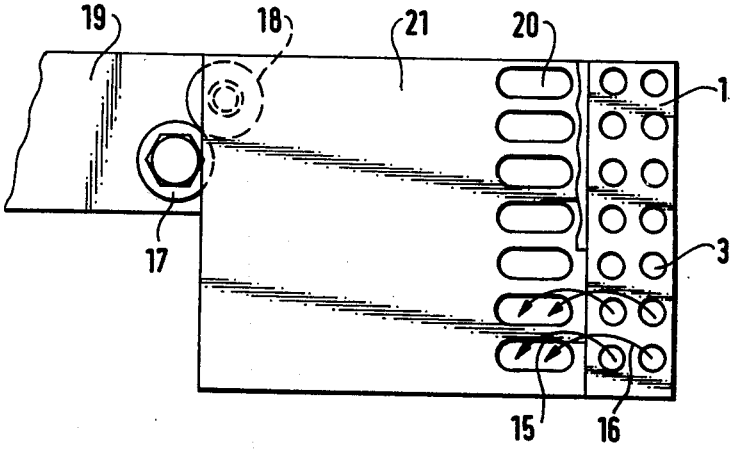

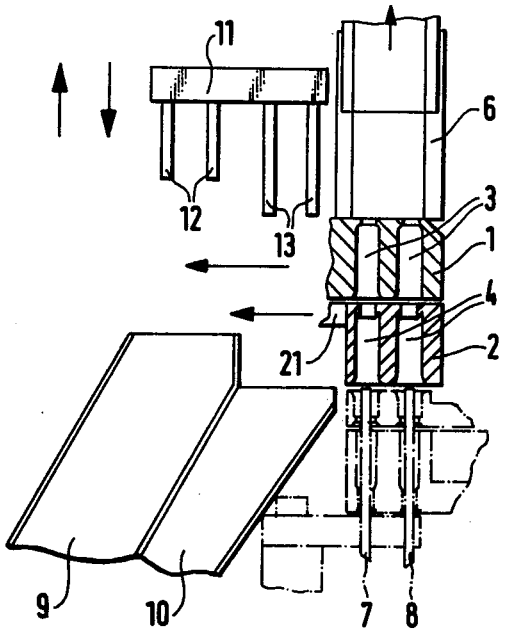
FIG. 2
FIG. 5
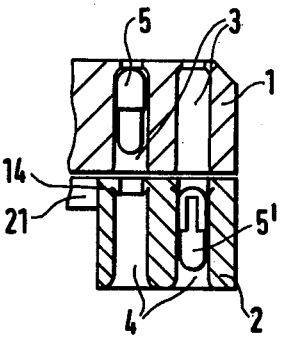
FIG. 3
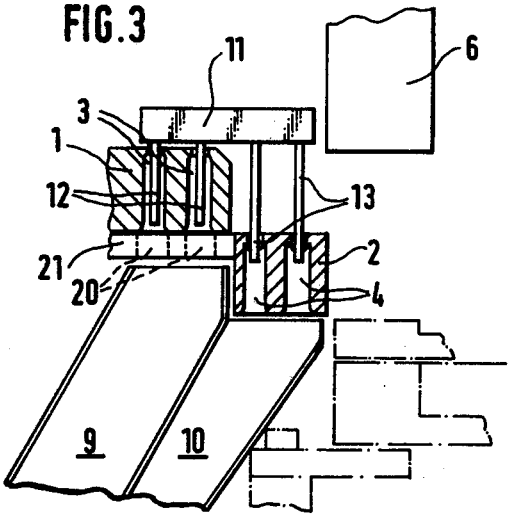

APPARATUS FOR SORTING CAPSULES AND THE LIKE

BACKGROUND OF THE INVENTION

The invention relates generally to machinery for handling packages, in particular capsules, for example hard gelatin capsules for holding pharmaceuticals and the like. Still more particularly, the invention relates to an apparatus for handling hard gelatin capsules which separates properly filled and closed capsules from defective capsules or from partially completed capsules, i.e. capsule bottoms only which may or may not be filled with the powder contents.

When hard gelatin capsules or the like are filled with powder it may happen that some of the capsule bottoms are not provided with a top after filling. Furthermore, during the telescoping of the top and bottom portions, one may be slit open by the other. Usually, it is the wall of the bottom half of the capsule which is slit by the application of the top half. In order to select from all the capsules produced only those which are neither defective, i.e. slitted, nor lack the top of a capsule, it is necessary to separate out the unacceptable capsules. This includes both the slitted capsules as well as the filled but open capsule bottoms. In known machinery, it has been necessary heretofore to station an operator for manually removing from the stream of capsules those which had the above-described defects. Such manual sorting is expensive and is physically demanding. Furthermore, the efficacy of selection is gradually reduced when an operator performs this function for an extended period of time.

OBJECT AND SUMMARY OF THE INVENTION

It is thus a principal object of the present invention to provide capsule sorting machinery which is fully automatic and which reliably removes from a stream of filled capsules those that are defective by way of having slitted walls as well as those which lack a top. A further object of the invention is that the powder contents of capsule bottoms are aspirated by suction and removed from the vicinity of the machine, thus not contributing to the soiling of the machinery or the goods.

Still another object of the invention is to provide a sorting mechanism which requires relatively small space due to the short paths of movable machine members thus permitting installation in known capsule-filling and-closing machinery. These and other objects are attained, according to the present invention, by providing two separate capsule-holding slides capable of relative movement, each of the two slides having bores for receiving capsules, and the bores in the lower slide, i.e. the one first receiving the capsules, being provided with a calibrated diameter for retaining defective capsules. The invention further provides a suction device which applies suction to the top of the upper slide, thereby urging the capsules to move from the bores in the lower slide into the bores of the upper slide.

The invention will be better understood as well as further objects and advantages thereof become more apparent from the ensuing detailed description of a preferred embodiment taken in conjunction with the drawing.

BRIEF DESCRIPTION OF THE DRAWINGS

FIG. 1 is a schematic illustration of a part of a capsule-filling and-closing machine;

FIG. 2 is a sectional illustration of a front-elevational view of the portion of the machine serving for sorting the capsules;

FIG. 3 is an illustration similar to that of FIG. 2 but showing the parts of the machine in the position for expulsion of the capsules;

FIG. 4 is a top view of the elements of FIGS. 2 and 3; and

FIG. 5 is an enlarged illustration of portions of the capsule-holding slides.

DESCRIPTION OF THE PREFERRED EMBODIMENT

Turning now to FIG. 1, there will be seen a partially schematic and sectional illustration of a portion of the capsule sorting machine in which the elements that are subject to the present invention are indicated by an arrow A. These elements include, as is particularly evident from FIGS. 2 and 3, two vertically superimposed slides 1 and 2. The slides 1 and 2 may be located as illustrated in FIG. 2, in which they occupy a position for receiving previously filled and capped capsules, and may be moved by mechanical means to be described below into a second position, illustrated in FIG. 3, in which capsules retained in the bores of the two slides are expelled into appropriate separate chutes. The slide 1 has bores 3 and the slide 2 has bores 4 for receiving gelatin capsules 5 and defective capsules 5' which may have the defect of having split walls or be lacking a top. (See in particular FIG. 5) Disposed above the slide 1 is a suction device 6 for applying suction to the top of the bores 3 and 4. Disposed below the slide 2 are pestles 7 and 8 which serve to push filled capsules 5 or 5' into the bores 4 of the slide 2. The mechanical actuation of the pestles 7 and 8 is performed by known means not illustrated. Further provided in the left of FIGS. 2 and 3 are chutes 9 and 10, respectively serving for intact and usable capsules and for slitted or otherwise defective capsules, for example those lacking a top. Provided directly above the chutes 9 and 10 is a bracket 11 which supports rods 12 and 13 of different length which are used for expelling capsules from the bores 3 and 4, as will be described below. FIG. 2 is an illustration of the slides and the associated mechanisms in the position they occupy when receiving capsules from the capsule filling machine. FIG. 3 illustrates the delivery position occupied by the slides 1 and 2 when the rods 12 and 13 expel the capsules in the bores into the chutes 9 and 10, respectively.

The above-described apparatus operates as follows.

Under the control of actuators, not shown, the pestles 7 and 8 push presumably filled and closed capsules into the bores 4 of the slide 2. The suction mechanism 6 applies suction to the bores 4 thereby causing them to be lifted into the bores 3 of the slide 1 unless they are retained due to malformation or external defects. For example, as shown in FIG. 5, a slitted capsule 5' will be caught in the calibrated part of the bore 4 of the slide 2, in particular at the sharp edges 14 of the bore 4. Accordingly, the intact capsules 5 will be retained against the reduced top opening of the channels 3 in the slide 1 as illustrated in FIG. 5, whereas a slitted capsule or otherwise malformed capsule 5' will be retained in the channels 4 as also shown in FIG. 5. After the insertion of the capsules 5 or 5' into the bores 4 and the application of suction, the slide 1 is laterally displaced from the slide 2, i.e. from the position shown in FIG. 2, into that shown in FIG. 3. During this lateral displacement, the suction on the bores 3 and 4 is maintained. In order to prevent that capsules drop out of the bores 3 after they leave the influence of the suction mechanism, slide 2 not only executes a lateral motion with respect to the slide 3 but a transverse motion of limited duration as illustrated in FIG. 4 by the arrows 15 and 16. This arcuate motion of the slide 1 with respect to slide 2 is produced by the cooperation of two rollers 17 and 18, the roller 17 being mounted on the base plate 19 of the lower slide 2 while the roller 18 is mounted rotatably at the bottom of the slide 1. After the displacements via the rollers 17 and 18, the slides 1 and 2 occupy the positions shown in FIGS. 3 and 4, i.e. positions in which the bores 3 of the upper slide 1 come to lie directly above corresponding slits 20 of a machine member 21 connected to the slide 2.

Once the slides 1 and 2 have reached the relative position shown in FIG. 3, which is the position required for removal of the capsules, the bracket 11 is moved downwardly so that the rods 12 and 13 enter, respectively, the bores 3 of slide 1 and the bores 4 of slide 2. Due to this downward motion, the capsules 5 contained in the bores 3 are projected into the chute 9 while any capsules or portions of capsules retained in the bores 4 of slide 2 are projected therefrom into the reject chute 10. Subsequently, the slides 1 and 2 are returned into their receiver position illustrated in FIG. 2 after which a new insertion of capsules 5 or 5' begins.

If the pestles 7 and 8 insert incomplete capsules, i.e. capsule bottoms which may be filled with powder but which lack tops, the powder contents are aspirated by the suction mechanism 6. The capsule bottoms may well be retained by the sharp edges 14 of the calibrated bores 4 as was the case with the malformed capsules 5', or they may be aspirated by the suction device together with the contents. In either case, such capsules are unable to acquire residence in the bores 3 and thus cannot be delivered to the chute 9.

The foregoing relates to a preferred exemplary embodiment of the invention, it being understood that other embodiments and variants thereof are possible within the spirit and scope of the invention.

What is claimed and desired to be secured by Letters Patent of the United States is:

1. An apparatus for sorting capsules, comprising:

a first member having a plurality of cylindrical apertures therein for receiving capsules, said capsules including intact capsules having a top part and a bottom part and having been filled with powdery contents and also including defective capsules, lacking at least the top part or being deformed;

a second member disposed in juxtaposition to and movable with respect to said first member and also having a plurality of cylindrical apertures;

means for permitting said first and second members to assume a first relative position in which the cylindrical apertures of both members are axially aligned permitting movement of intact capsules into the cylindrical apertures of said second member and a second relative position in which the cylindrical apertures of said first and second members are relatively displaced; and suction means, for applying suction to the capsules in said first and second members, said suction means being adapted to urge intact capsules to be transferred from said first member to said second member and aspirate and remove the powdered contents of any capsule lacking a top part.

2. An apparatus as defined by claim 1, further comprising first and second chutes, so disposed that, in said second relative position of said first and second members, the cylindrical apertures of said first member are in communication with said first chute while the cylindrical apertures of said second member are in communication with said second chute.

3. An apparatus as defined by claim 2, further comprising a movable bracket disposed above said second member having a plurality of rods which are aligned in said second position with the cylindrical apertures of said first and second members, said bracket being able to execute movement permitting said rods to enter said cylindrical apertures and dislodge therefrom capsules contained therein.

4. An apparatus as defined by claim 1 wherein said second member moves from said first position while traversing an arcuate path with respect to said first member.

5. An apparatus as defined by claim 4, wherein the means for performing an arcuate motion of said second member with respect to said first member includes mutually cooperating pivotal means one of which is attached to said first member and the other of which is pivotally attached to a stationary machine member.

* * * * *